United States Patent [19]

Flint et al.

[11] Patent Number: 5,012,112

[45] Date of Patent: Apr. 30, 1991

[54] INFRARED SCENE PROJECTOR

[75] Inventors: Graham W. Flint, Albuquerque, N. Mex.; Harold A. Papazian; Ludwig G. Wolfert, both of Littleton, Colo.

[73] Assignee: Martin Marietta Corporation, Bethesda, Md.

[21] Appl. No.: 313,082

[22] Filed: Feb. 21, 1989

[51] Int. Cl.[5] ..... H01J 1/46

[52] U.S. Cl. ..... 250/493.1; 250/334; 250/504 R; 313/423

[58] Field of Search ..... 250/493.1, 495.1, 333, 250/334, 330; 313/462, 408, 35, 423; 356/246

[56] References Cited

U.S. PATENT DOCUMENTS

| | | | |
|---|---|---|---|
| 2,980,763 | 4/1961 | Lasser | 250/334 |
| 3,146,368 | 8/1964 | Fiore et al. | 313/408 |
| 3,202,759 | 8/1965 | Forgue | 250/334 |
| 3,239,605 | 3/1966 | Cholet et al. | 250/334 |
| 3,308,326 | 3/1967 | Kaplan | 313/467 |
| 3,909,521 | 9/1975 | Hunt et al. | 250/334 |
| 3,939,347 | 2/1976 | Shifrin | 250/334 |
| 3,990,038 | 11/1976 | Jensen et al. | 313/423 |
| 4,542,299 | 9/1985 | Scholz et al. | 250/493.1 |
| 4,565,946 | 1/1986 | Barrett et al. | 313/467 |
| 4,572,958 | 2/1986 | Durand et al. | 250/495.1 |
| 4,899,080 | 2/1990 | Vriens et al. | 313/35 |

OTHER PUBLICATIONS

J. M. Alberigs and J. M. L. Penninger: An Improved Window Seal for High Temperature-Pressure Spectroscopic Flow Cells Rev. Sci. Instrum., vol. 45, No. 3, Mar. 1974, pp. 460–461.

*Primary Examiner*—Jack I. Berman
*Assistant Examiner*—Kiet T. Nguyen
*Attorney, Agent, or Firm*—MacDonald J. Wiggins; Gay Chin

[57] ABSTRACT

An infrared scene projector has a cathode ray tube with a display screen coated with a luminescent phosphor material that produces radiation in the infrared spectrum when excited by the electron beam. The desired screen images are generated electronically, the screen is scanned by the cathode ray beam, and the intensity of the beam is modulated by the signal from the image generator.

18 Claims, 3 Drawing Sheets

PRIOR ART

INFRARED SCENE PROJECTOR

BACKGROUND OF THE INVENTION

1. Field of the Invention

The present invention relates to television type displays, and more particularly to a display for producing and projecting dynamic scenes using infrared radiations.

2. Description of the Prior Art

It is well known to utilize cathode ray tubes for producing visible images and changing scenes on a phosphor coated screen. Generally, such devices produce monochrome and color images within the visible light spectrum for human viewing and interpretation. While a wide range of phosphors have been used for various applications, little attention has been given materials which will produce radiations in the infrared region of the spectrum.

There is a need for a dynamic scene projector and display in which the images are produced by infrared (IR) radiations for testing of imaging devices used for night vision and similar applications. Such a device would in the desired wavebands have sufficient emission intensity, display resolution and range of intensity to simulate the type of scene to which IR imaging devices are applied. An important application for devices of this type is for testing of high speed optical sensors such as those postulated for many scenarios of the strategic defense initiative. Another application of an IR display is to provide IR images as decoys in military space defense scenarios when phosphor particles are excited by laser or electron beam.

A cathode ray tube having emissions in the wave length range of 2 μm to 15 μm is required for the above noted applications. In U.S. Pat. No. 4,652,793, a tube having a screen of luminescent indium orthoborate is disclosed which produces radiation peaked at about 0.8 μm. Barrett et al., in U.S. Pat. No. 4,565,946, teach an IR phosphor for use with light pens which produces radiation at about 0.78 μm and 1.02 μm. No prior art cathode ray tube devices are known for producing radiation in the 2–15 um region of the spectrum. Prior art attempts at producing IR scenes have used matrices of small heat emitters. For example, a 64×64 matrix of heater buttons has been built which produces low resolution, low bandwidth scenes with a high temperature background. The desired device must have high resolution, rapid updating, low temperature background, and for test purposes, the ability to define a large number of targets. Achieving such characteristics with point heat sources would be complex and expensive. Also, the point source device would be affected by thermal blooming, and would be slow to respond to changes, and would produce low contrast due to a high temperature background.

SUMMARY OF THE INVENTION

The present invention utilizes a cathode ray tube with a display screen of phosphor material luminescent in the infrared. The phosphor may be in the form of particles coated on a screen or of a single crystal plate. Some of these phosphor materials are as follows:

Indium arsenide (InAs);
Indium antimonide (InSb);
Indium arsenide antimonide ($InAs_{1-x}Sb_x$);
Mercury cadmium telluride ($HgCd_{1-x}Te_x$);
Lead sulfide (PbS)
Lead selenide (PbSe).
Lead sulfide selenide ($PbS_{1-x}Se_x$);
Tellurium (Te);
Lead telluride (PbTe);
Lead tin telluride ($Pb_{1-x}Sn_xTe$);
Lead tin selenide ($Pb_{1-x}Sn_xSe$);
Lead germanium telluride ($Pb_{1-x}Ge_xTe$);
Lead germanium sulfide ($Pb_{1-x}Ge_xS$);
Lead cadmium sulfide ($Pb_{1-x}Cd_xS$);
Zinc sulfide+0.1% cobalt (Zns+0.1% Co);
Calcium fluoride+2–10% dyprosium (CaF+2–10% Dy);

The values for x are selected between 0 and 1 to achieve emission in the desired waveband. FIG. 1 shows ranges of wavebands for various materials.

The efficiency of the phosphor crystals in emitting infrared radiation is enhanced at lower temperatures. Therefore, the phosphor is cooled by evaporating cryogenic fluids ($N_2$, He) or by thermal conduction from a cold source (cold finger). For many applications, the window is not cooled to cryogenic temperatures to avoid condensation of surrounding gases such as water vapor. A very cold window would require control of the surrounding gases so that no condensation on the windows can occur.

Driver electronics produce the desired screen images by rapidly deflecting the electron beam and controlling its intensity. The position and brightness of targets on the screen can be updated at rates of 1000 frames per second and lower.

It is therefore a principal object of the invention to provide a system having a cathode ray tube for emission of infrared radiations, and a scene projector for producing dynamic, high resolution, wide intensity range images on the screen of the cathode ray tube.

It is another object of the invention to provide a cathode ray tube having a phosphor that produces radiation in the range of 2–15 μm at high efficiency.

It is still another object of the invention to provide a cathode ray tube producing infrared images against a low temperature background.

It is yet another object of the invention to present a system for testing infrared tracking and detection devices that produces scenes having a large number of targets, rapid updating, and a high contrast.

These and other objects and advantages of the invention will become apparent from the following detailed description when read in conjunction with the drawings.

DETAILED DESCRIPTION OF THE PREFERRED EMBODIMENT

Figure 1:
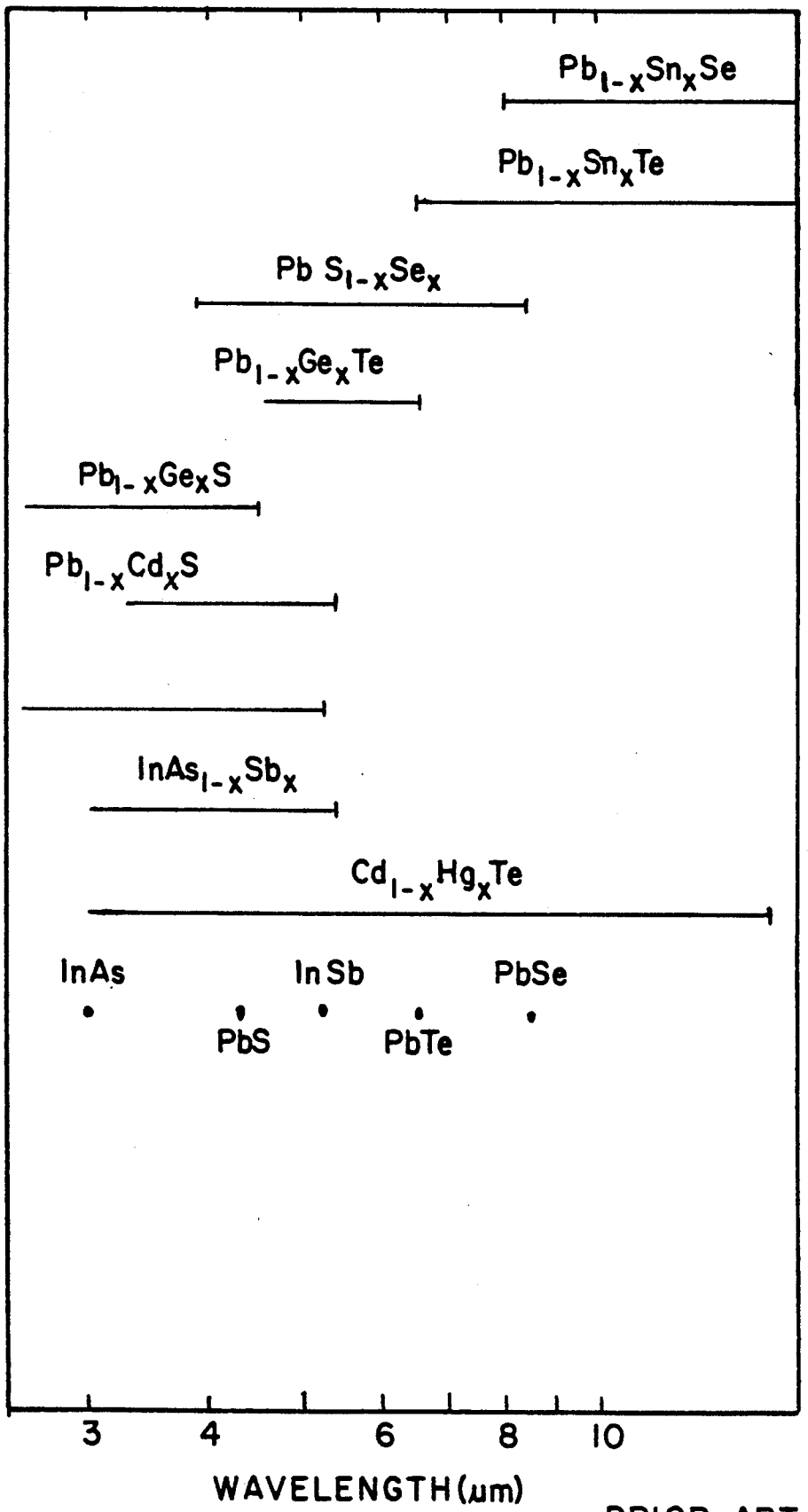
FIG. 1 is a graph showing possible emission wavelengths for various infrared emitting materials.
Figure 2:
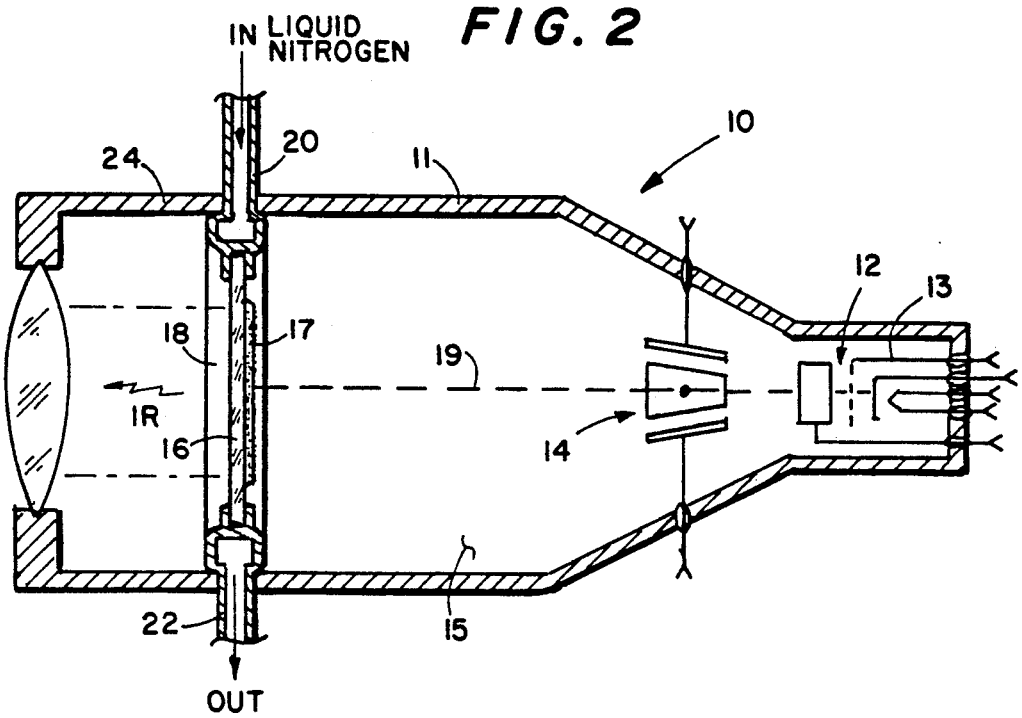
FIG. 2 is a cross sectional view of a cathode ray tube for producing infrared emissions in accordance with the invention.

Referring to FIG. 2, a cross sectional view of the preferred embodiment of a cathode ray tube 10 to be used in the system of the invention. An envelope 11, which may be of a suitable metal, glass or ceramic, is provided having an electron gun 12 disposed at an end thereof. A filter window 16 is supported in cooling frame 18. A frame 18 is formed from metal tubing to surround a coated window 16 and includes an inlet connection 20 and an outlet connection 22.

Window 16 is of a material transparent to infrared radiation of the selected waveband. Typical window materials are sapphire, quartz, and lithium fluoride. These materials have transmission bands falling within 0.14 microns to 8.5 microns. Window 16 therefore acts as a filter for other wavelengths of radiation.

A luminescent phosphor infrared emitting material layer or coating 17 is applied to window 16. Layer 17, in a preferred embodiment, is indium arsenide. However, other materials discussed herein above are suitable. Doping of indium arsenide with zinc, tin or selenium can be used to produce longer wavelengths of emitted infrared radiation. Emitting coating 17 may be deposited on window 16 by vacuum deposition, sputtering or by silk screening a transparent or semitransparent layer. An alternative procedure is to replace the coated window 16 by a plate of phosphor material which is not opaque to the emitted infrared emissions of the phosphor temperature.

Chamber 15 formed by envelope 11, window 16 and cooling frame 18, is evacuated and hermetically sealed. In operation, electron beam 19 from electron gun 12 impinges on emitting layer 17 which will produce infrared radiation 21 therefrom having an intensity determined by the intensity of beam 19 and the temperature of the material of emitting coating 17. To improve the efficiency of emission and to produce a low temperature background, a coolant such as a cold gas, a cold fluid, or an evaporating fluid such as liquid nitrogen is circulated into inlet 20, around cooling frame 18 and out outlet 22.

To produce a scene, beam 19 is scanned by vertical and horizontal deflection system 14, shown schematically, and the beam modulated by control grid 13. The infrared emissions from layer 17 are filtered by window 16, pass through chamber 24 and are projected by lens 26. Chamber 24 may be sealed and evacuated, or filled with a non-condensing gas such as dry nitrogen or helium. Although electrostatic deflection is shown for exemplary purposes, magnetic deflection is equally applicable.

As is known in the art, the electron beam 19 excites the electrons in infrared emitting coating 17 to higher energy levels which emit photons with wavelengths determined by the material band gap energy as the electron drops from the conduction band to the valence band. The intensity of luminescence of the emissions is proportional to the current of beam 19 over several decades. A typical electron beam spot diameter d in inches is given by $$d=0.6\times I^{0.4},$$

where I is the electron beam current in amperes. Use of a high efficiency phosphor permits a small electron beam spot size to be used producing high resolution.

ALTERNATIVE EMBODIMENT

Figure 3:
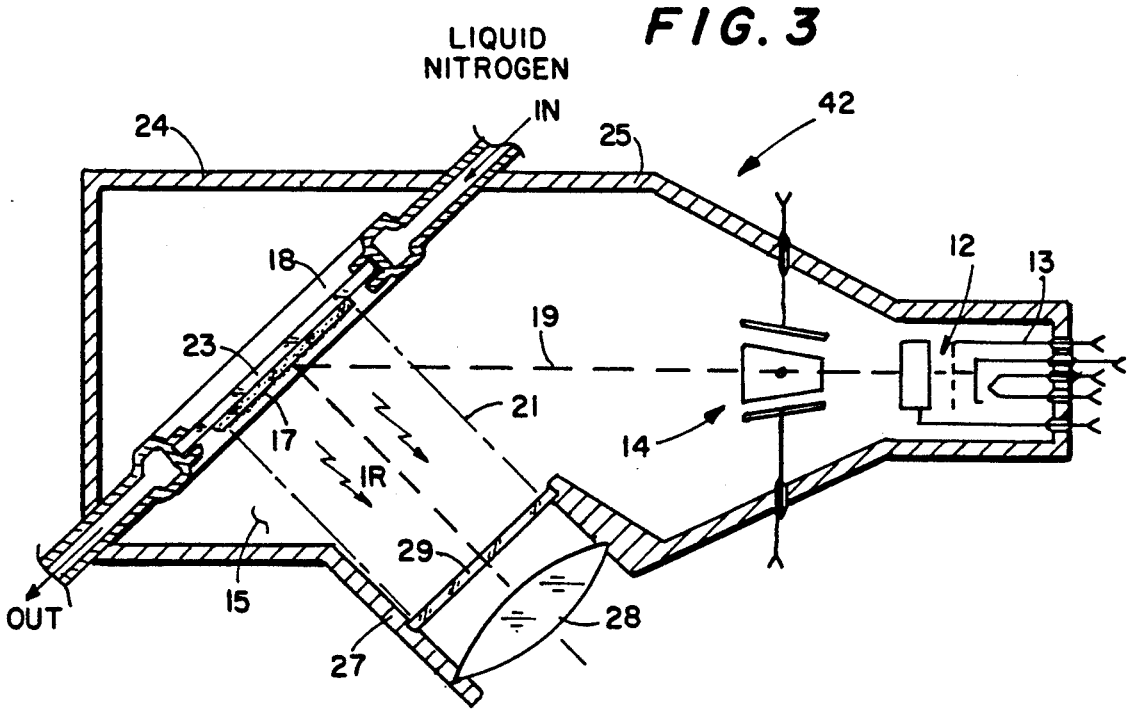
FIG. 3 is a cross sectional view of an alternative embodiment of the cathode ray tube of FIG. 2.

Referring now to FIG. 3, an alternative embodiment of the invention is shown in cross-sectional view. An infrared cathode ray tube 42 having a sealed envelope 25 provides evacuated chamber 15 and includes a port 27 for supporting lens 28. An electron gun 12 and electrostatic deflection system 14, as in the embodiment of FIG. 2, produces and scans electron beam 19. A target plate 23 has an emitting coating 17 deposited thereon and is disposed at an angle with respect to electron beam 19, which scans coating 17. Infrared radiation 21 is produced in accordance with the invention and is directed toward lens 28 mounted in port 27. A filter 29 may be provided if required. The configuration of FIG. 3 permits construction of the infrared scene projector with a phosphorous screen layer which is opaque to the infrared wavelengths.

Figure 4:
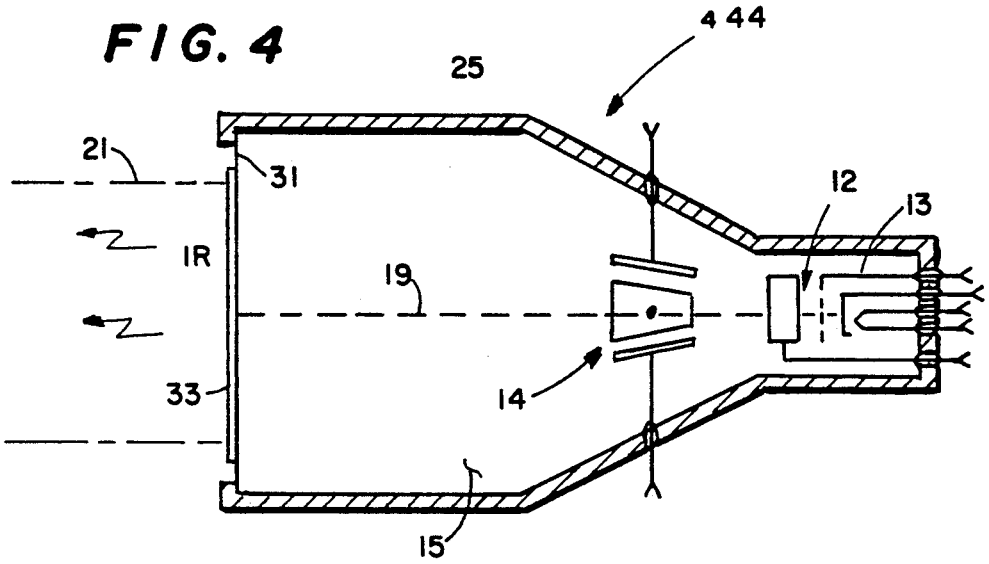
FIG. 4 is a cross sectional view of another embodiment of the cathode ray tube of FIG. 2 in which infrared emissions are produced external to the tube.

Another alternative infrared cathode ray tube 14 is shown in FIG. 4. in which envelope 25 has a thin, vacuum-tight membrane disposed across the open end thereof, and an electron gun 12 and deflection system 14. The membrane permits passage of electron beam 19 from gun 12 therethrough. An IR phosphor layer 33 is deposited on the outer side of membrane 31 and is excited by scanned beam 19 to produce IR radiation 21. This construction does not require an IR window.

Figure 5:
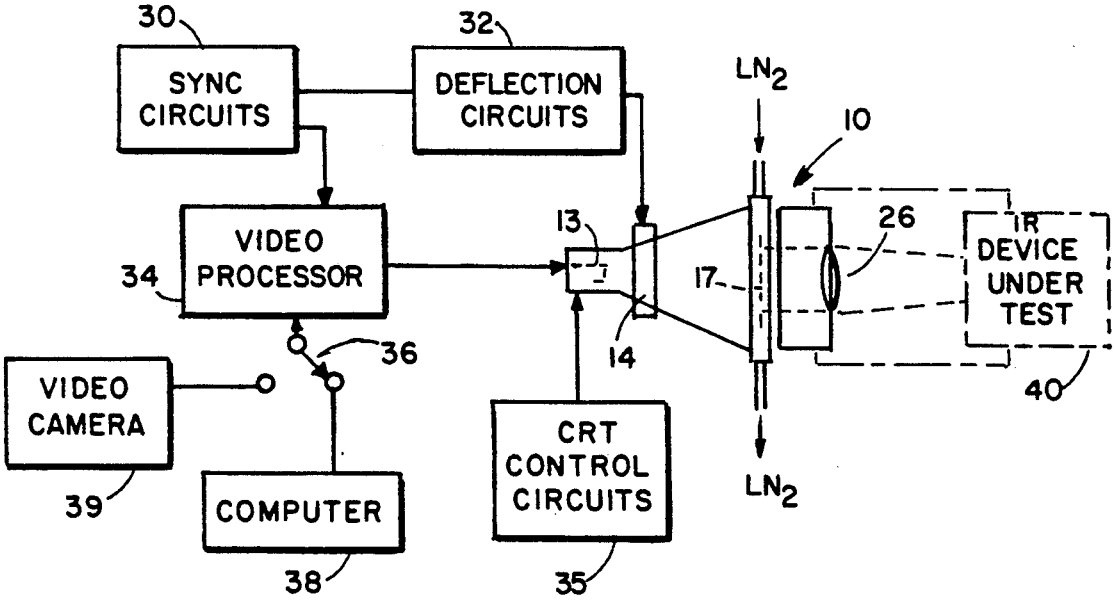
FIG. 5 is a simplified block diagram of the infrared scene generator system of the invention.

Having disclosed the novel infrared cathode ray tubes 10, 42 and 43, the scene generation system will be described with reference to the schematic representation and block diagram of FIG. 5. For exemplary purposes, tube 10 is shown. The system is shown being used for testing an IR target tracking device 40. Cathode ray tube 10 is coupled to device 40. Images produced by layer 17 are projected by lens 26 onto the sensing elements of device 40. Synchronization circuits 30 control deflection circuits 32 to produce a raster on coating 17. A video processor 34 has an output connected to control grid 13 of cathode ray tube 10. Scenes may be produced from a video camera 39, or produced by programs resident in computer 38, selectable by switch 36. Conventional cathode ray tube control circuits 35 are provided to adjust the brightness and focus of the image on coating 17.

In one implementation of the invention, a spectrum peaked at 3 μm was obtained. Scenes were produced with a resolution of 100 lines per inch at a frame rate greater than 100 frames per second.

Although specific embodiments of the invention have been disclosed, these are to be considered as examples, and many variations are possible without departing from the spirit and scope of the invention.

We claim:

1. A system for producing dynamic scenes represented by infrared radiations comprising:

(a) a cathode ray tube including (i) an elongate evacuated envelope, (ii) an electron gun at one end of said envelope for producing an electron beam, (iii) a window transparent to infrared radiations disposed at the other end of said envelope;

(iv) a luminescent phosphor layer on said window, said phosphor emitting infrared radiations upon excitation by said electron beam from said gun, (v) grid means for modulating said electron beam intensity, and (vi) means for deflecting said electron beam;

(b) scanning means for producing a raster on said phosphor layer and connected to said deflecting means; and (c) means for generating a video signal representative of a dynamic scene and having an output connected to cathode ray tube modulating grid means for producing a representation of said dynamic scene by infrared radiation from said layer.

2. The system as recited in claim 1 in which said phosphor is selected from the group consisting of InAs; InSb; $InAS_{1-x}Sb_x$; Zns+0.1% Co; $CaF_2$+2-10% Dy; $Hg_xCd_{1-x}Te$; PbTe; PbS; PbSe; $PbS_{1-x}Se_x$; Te; $Pb_{1-x}Sn_xTe$; $Pb_{1-x}Sn_xSe$; $Pb_{1-x}Ge_xTe$; $Pb_{1-x}Ge_xS$; and $Pb_{1-x}Cd_xS$.

3. The system as recited in claim 1 in which said cathode ray tube further includes cooling means for reducing the temperature of said phosphor layer.

4. The system as recited in claim 3 in which said cooling means includes:

a hollow frame surrounding said window; and means for circulating a coolant through said frame.

5. The system as recited in claim 4 in which said coolant is selected from the group consisting of a cold gas, a cold fluid, and an evaporating fluid.

6. The system as recited in claim 3 in which said coolant is liquid nitrogen.

7. The system as recited in claim 1 in which said cathode ray tube further includes a lens disposed external to said envelope for projecting said infrared representation of said scene.

8. The system as recited in claim 1 in which said window is formed from a material selected from the group consisting of sapphire, quartz, and lithium fluoride.

9. The system as recited in claim 1 in which said window has a transmission band within the range of 0.14 microns to 15 microns.

10. The system as recited in claim 1 in which said video signal generating means includes:

a computer programmed to produce a sequence of video signals representative of said dynamic scenes;

a video processor having an input connected to said computer and an output connected to said cathode ray tube.

11. A system for producing dynamic scenes represented by infrared radiations comprising:

(a) a cathode ray tube including (i) an evacuated envelope, (ii) an electron gun at one end of said envelope for producing an electron beam, (iii) a target plate disposed in said envelope at an angle with respect to said electron beam;

(iv) a luminescent phosphor layer on said target plate, said phosphor emitting infrared radiations upon excitation by said electron beam from said gun, (v) grid means for modulating said electron beam, and (vi) means for deflecting said electron beam;

(b) scanning means connected to said deflecting means for producing a raster on said phosphor layer;

(c) means for generating a video signal representative of a dynamic scene having an output connected to said cathode ray tube modulating grid means for receiving said video signal and producing a representation of said dynamic scenes therefrom by infrared radiation from said layer.

12. The system as recited in claim 11 in which said phosphor is selected from the group consisting of InAs; InSb; $InAS_{1-x}Sb_x$; Zns+0.1% Co; $CaF_2$+2-10% Dy; $Hg_xCd_{1-x}Te$; PbTe; PbS; PbSe; $PbS_{1-x}Se_x$; Te; $Pb_{1-x}Sn_xTe$; $Pb_{1-x}Sn_xSe$; $Pb_{1-x}Ge_xTe$; $Pb_{1-x}Ge_xS$; and $Pb_{1-x}Cd_xS$.

13. The system as recited in claim 11 in which said cathode ray tube further includes cooling means for reducing the temperature of said phosphor layer.

14. The system as recited in claim 13 in which said cooling means includes:

a hollow frame surrounding said window; and means for circulating a coolant through said frame.

15. The system as recited in claim 11 in which said cathode ray tube further includes a lens disposed in said envelope opposite said target plate for projecting said infrared representation of said scene.

16. The system as recited in claim 15 which further comprises a window disposed in said envelope adjacent said lens, said window formed from a material selected from the group consisting of sapphire, quartz, and lithium fluoride.

17. The system as recited in claim 15 in which said window has a transmission band within the range of 0.14 microns to 15 microns.

18. A system for producing dynamic scenes represented by infrared radiations comprising:

(a) a cathode ray tube including (i) an elongate evacuated envelope, (ii) an electron gun at one end of said envelope for producing an electron beam, (iii) a membrane transparent to said electron beam disposed at and forming the other end of said envelope;

(iv) a luminescent phosphor layer deposited on an exterior surface of said membrane, said phosphor emitting infrared radiations upon excitation by said electron beam from said gun, (v) grid means for modulating said electron beam intensity, and (vi) means for deflecting said electron beam;

(b) scanning means for producing a raster on said phosphor layer and connected to said deflecting means;

(c) means for generating a video signal representative of a dynamic scene and having an output connected to cathode ray tube modulating grid means for producing a representation of said dynamic scene by infrared radiation from said layer.

* * * * *